US011306635B2

(12) United States Patent
Zink et al.

(10) Patent No.: US 11,306,635 B2
(45) Date of Patent: Apr. 19, 2022

(54) METHOD AND DEVICE FOR REGENERATING A PARTICULATE FILTER IN A MOTOR VEHICLE WITH A HYBRID DRIVE

(71) Applicant: VOLKSWAGEN AKTIENGESELLSCHAFT, Wolfsburg (DE)

(72) Inventors: Florian Zink, Bad Rappenau (DE); Christoph Nee, Wolfsburg (DE)

(73) Assignee: VOLKSWAGEN AKTIENGESELLSCHAFT, Wolfsburg (DE)

( * ) Notice: Subject to any disclaimer, the term of this patent is extended or adjusted under 35 U.S.C. 154(b) by 0 days.

(21) Appl. No.: 16/346,535

(22) PCT Filed: Oct. 25, 2017

(86) PCT No.: PCT/EP2017/077313
§ 371 (c)(1),
(2) Date: Apr. 30, 2019

(87) PCT Pub. No.: WO2018/082986
PCT Pub. Date: May 11, 2018

(65) Prior Publication Data

US 2019/0301329 A1 Oct. 3, 2019

(30) Foreign Application Priority Data

Nov. 3, 2016 (DE) ..... 10 2016 120 938.4

(51) Int. Cl.
*F01N 3/02* (2006.01)
*F02D 41/02* (2006.01)
(Continued)

(52) U.S. Cl.
CPC ..... *F01N 3/0238* (2013.01); *F02D 41/029* (2013.01); *F02D 41/123* (2013.01);
(Continued)

(58) Field of Classification Search
CPC .. F01N 3/0238; F01N 2590/11; F02D 41/024; F02D 41/029; F02D 41/123; F02D 2200/0812
(Continued)

(56) References Cited

U.S. PATENT DOCUMENTS 6,865,883 B2 3/2005 Gomulka
2009/0033095 A1* 2/2009 Aswani ..... F02D 41/029 290/2
(Continued)

FOREIGN PATENT DOCUMENTS

CN 101655024 A 2/2010
CN 101676530 A 3/2010
(Continued)

OTHER PUBLICATIONS

Machine Translation FR 2982317 (Year: 2020).*
(Continued)

*Primary Examiner* — Audrey B. Walter
*Assistant Examiner* — Dapinder Singh
(74) *Attorney, Agent, or Firm* — Pearl Cohen Zedek Latzer Baratz LLP

(57) ABSTRACT

The invention relates to a method for regenerating a particulate filter in the exhaust gas channel of a motor vehicle with a hybrid drive consisting of an electric motor and an internal combustion engine. In this context, the internal combustion engine is lugged by the electric motor in order to regenerate the particulate filter. The internal combustion engine transports oxygen-rich air into the exhaust gas channel, a process in which the soot retained in the particulate
(Continued)

filter is oxidized by the oxygen and the particulate filter can thus be regenerated. In this process, during the regeneration of the particulate filter, the quantity of air is controlled by a throttle valve in the air supply means of the internal combustion engine in order to allow the particulate filter to be regenerated as quickly and efficiently as possible. The invention also relates to a motor vehicle with a hybrid drive comprising an internal combustion engine and an electric motor, whereby the hybrid drive has a control unit to carry out such a method for the regeneration of the particulate filter.

13 Claims, 4 Drawing Sheets

(51) Int. Cl.
*F02D 41/12* (2006.01)
*F01N 3/023* (2006.01)

(52) U.S. Cl.
CPC ..... *F01N 2590/11* (2013.01); *F02D 41/024* (2013.01); *F02D 2200/0812* (2013.01)

(58) Field of Classification Search
USPC ..... 60/274, 277, 286, 295, 297, 311
See application file for complete search history.

(56) References Cited

U.S. PATENT DOCUMENTS

| | | | | |
|---|---|---|---|---|
| 2010/0043404 | A1* | 2/2010 | Hebbale | F02D 41/021 60/286 |
| 2011/0257821 | A1 | 10/2011 | Beaucaire et al. | |
| 2014/0041362 | A1 | 2/2014 | Ulrey et al. | |
| 2014/0190147 | A1 | 7/2014 | Roos et al. | |
| 2016/0201534 | A1 | 7/2016 | Lambert et al. | |
| 2016/0222898 | A1 | 8/2016 | Ulrey et al. | |
| 2016/0339905 | A1* | 11/2016 | Inoue | F01N 11/002 |

FOREIGN PATENT DOCUMENTS

| | | | |
|---|---|---|---|
| CN | 102733910 | A | 10/2012 |
| CN | 102933805 | A | 2/2013 |
| CN | 103912345 | A | 7/2014 |
| CN | 103917756 | A | 7/2014 |
| CN | 103930327 | A | 7/2014 |
| CN | 104806365 | A | 7/2015 |
| CN | 205370693 | U | 7/2016 |
| DE | 10 2008 028 448 | A1 | 2/2009 |
| DE | 10 2009 038 110 | A1 | 4/2010 |
| DE | 10 2012 022153 | | 5/2014 |
| DE | 10 2013 202 142 | A1 | 8/2014 |
| DE | 103 40 934 | B4 | 5/2016 |
| DE | 10 2016 100 151 | A1 | 7/2016 |
| DE | 10 2015 015 794 | A1 | 8/2016 |
| DE | 10 2016 101 105 | A1 | 8/2016 |
| DE | 11 2014 006 318 | T5 | 11/2016 |
| EP | 1 197 642 | A2 | 4/2002 |
| FR | 2 982 317 | A1 | 5/2013 |
| GB | 2 451 562 | A | 2/2009 |
| GB | 2549783 | * | 1/2017 |
| JP | 2013174170 | A | 9/2013 |
| JP | 5751784 | B2 | 7/2015 |
| RU | 2013137783 | A | 2/2015 |
| RU | 2014123377 | A | 12/2015 |
| WO | WO 2011/104459 | A1 | 9/2011 |

OTHER PUBLICATIONS

International Search Report of PCT Application No. PCT/EP2017/077313, dated Mar. 14, 2018.
Search report for German Patent Application No. 10 2016 120 938.4, dated May 19, 2017.
Search Report for Russian Patent Application No. 2019116742/07, dated Feb. 12, 2021.
Office Action for Chinese Patent Application No. 201780067857.7, dated Mar. 30, 2021.
Office Action for European Patent Application No. 17797264.3, dated Dec. 13, 2021.

* cited by examiner

METHOD AND DEVICE FOR REGENERATING A PARTICULATE FILTER IN A MOTOR VEHICLE WITH A HYBRID DRIVE

CROSS-REFERENCE TO RELATED APPLICATIONS

This application is a National Phase Application of PCT International Application No. PCT/EP2017/077313, International Filing Date Oct. 25, 2017, claiming priority of German Patent Application No. 10 2016 120 938.4, filed Nov. 3, 2016, which is hereby incorporated by reference.

FIELD OF THE INVENTION

The invention relates to a method and to a device for regenerating a particulate filter in the exhaust gas channel of a motor vehicle with a hybrid drive.

BACKGROUND OF THE INVENTION

Since legislation on exhaust gas emissions is becoming increasingly stringent, car manufacturers have to comply with high requirements that are to be met by appropriate measures aimed at reducing the raw emissions of engines as well as by an appropriate exhaust-gas aftertreatment. The introduction of the European emission standard Euro 6 for gasoline engines or for motor vehicles with hybrid drives stipulates a limit value for the number of particles, in many cases calling for the use of a particulate filter. Such a particulate filter becomes loaded with soot as the vehicle is driven. In order to prevent the exhaust gas counter pressure from rising excessively, this particulate filter has to be continuously or periodically regenerated. For purposes of using oxygen to carry out a thermal oxidation of the soot retained in the particulate filter, a sufficiently high temperature level is needed in conjunction with the oxygen that is concurrently present in the exhaust gas system of the internal combustion engine. Since modern gasoline engines are normally operated without an oxygen excess at a stoichiometric air-fuel ratio ($\lambda=1$), additional measures are needed towards this end. One possibility for the regeneration of the particulate filter consists of introducing oxygen into the exhaust gas channel during overrun phases of the internal combustion engine, in other words, during phases in which no fuel is being injected and therefore an oxygen excess is present in the exhaust gas. Such overrun phases in an internal combustion engine, however, do not always take place regularly, but rather in a quite random and uncontrollable manner, so that the regeneration phase is triggered more often than actually necessary in order to prevent the risk of an excessively high loading of the particulate filter and the associated risk of thermal damage to the particulate filter caused by uncontrolled soot burn-off. In a worst-case scenario, such an uncontrolled soot burn-off could cause the particulate filter to burn through, thus destroying the particulate filter.

German patent specification DE 10 103 40 934 B4 discloses a method for regulating an internal combustion engine, whereby a distinction is made between the normal mode of operation and the regeneration mode of operation of the internal combustion engine, whereby during the normal mode of operation, the air mass fed to the internal combustion engine is regulated by an exhaust-gas return valve and a throttle valve, whereas during the regeneration, the exhaust-gas return valve is closed and the air mass fed to the internal combustion engine is regulated exclusively via the throttle valve.

German patent application DE 10 2016 101 105 A1 discloses a method for the regeneration of a particulate filter in an overrun mode of operation of an internal combustion engine, whereby the duration of an overrun phase, in which no fuel is injected into the combustion chambers of the internal combustion engine, is regulated as a function of the temperature of the particulate filter.

International patent application WO 2011/104459 A1 discloses a method for the regeneration of a particulate filter of an internal combustion engine in a hybrid vehicle. In this process, the temperature at the inlet of the particulate filter is continuously measured and compared to a first threshold value. This prevents the internal combustion engine from stopping if the temperature at the inlet of the particulate filter lies below this first threshold value. In this process, the internal combustion engine is prevented from stopping as long as the temperature at the inlet of the particulate filter lies above a second threshold value above which the internal combustion engine is allowed to stop.

European patent application EP 1 197 642 A2 discloses a method for the regeneration of a particulate filter in a hybrid vehicle. Here, the temperature of the exhaust gas is raised by increasing the load of the internal combustion engine in that the internal combustion engine not only powers the motor vehicle but also charges the battery of the electric motor of the hybrid vehicle.

A drawback of these approaches, however, is that it is still necessary to wait for overrun phases of the internal combustion engine in order to carry out a regeneration of the particulate filter, and the particulate filter continues to be regenerated more often than actually necessary.

SUMMARY OF THE INVENTION

The invention is thus based on the objective of achieving the quickest possible regeneration of a particulate filter as well as a gentle resumption of the combustion in the internal combustion engine in a hybrid vehicle with a hybrid drive consisting of an internal combustion engine and an electric motor.

According to the invention, this objective is achieved by means of a method for regenerating the particulate filter in the exhaust gas channel of a motor vehicle with a hybrid drive consisting of an electric motor and an internal combustion engine, said method comprising the following steps:

- the motor vehicle is operated in the hybrid mode of operation, whereby the exhaust gas of the internal combustion engine is transported through the particulate filter during the operation of the internal combustion engine,
- the load state of the particulate filter is ascertained,
- the regeneration of the particulate filter is initiated once the load state of the particulate filter has reached a defined maximum load state,
- a regeneration process of the particulate filter is carried out, whereby the internal combustion engine and the electric motor are coupled during the regeneration and the electric motor lugs the internal combustion engine, whereby
- the internal combustion engine transports air into the exhaust gas channel in order to oxidize the soot particles retained in the particulate filter, and whereby
- a throttle valve of the air supply means of the internal combustion engine is controlled during the regeneration of the particulate filter, irrespective of any torque demand the driver makes of the hybrid drive.

As a result, efficient overrun phases of the internal combustion engine are possible which can be actively effectuated by the torque of the electric motor. Therefore, it is not necessary to wait for an overrun phase caused by a given driving situation in order to initiate a regeneration, so that less frequent regeneration processes of the particulate filter are needed. In other words, in a motor vehicle with a hybrid drive, a regeneration phase of the particulate filter can be initiated once the particulate filter has reached a defined maximum load state. In this context, the term "overrun phase" refers to an operating state in which no fuel is being injected into one of the combustion chambers of the internal combustion engine and the internal combustion engine is not delivering any torque to the crankshaft. In this context, the expression "lugging of the internal combustion engine" refers to an operating state in which the electric motor has to generate a torque so as to turn the internal combustion engine. In this process, the internal combustion engine is turned at a rotational speed of more than 100 rpm, preferably at least 600 rpm, and preferably the injection of fuel into the combustion chambers of the internal combustion engine is completely discontinued. Since the internal combustion engine is being lugged by the electric motor during the regeneration of the particulate filter, the oxygen needed for the regeneration of the particulate filter is transported into the exhaust gas channel by means of the internal combustion engine. Therefore, regulating the throttle valve independently of the load demand allows the amount of oxygen needed for an optimal regeneration to be fed to the particulate filter via the throttle valve. Opening the throttle valve wide achieves a fast regeneration of the particulate filter, whereby closing the throttle valve reduces the air feed and prevents an uncontrolled soot burn-off on the particulate filter that could lead to destruction of the particulate filter. Therefore, in comparison to an unregulated regeneration with a closed throttle valve, it is possible to achieve a considerably faster and more effective regeneration of the particulate filter, as a result of which the lugging phase of the electric motor can be kept shorter and the motor vehicle can more quickly resume normal operation.

The measures put forward in the dependent claims constitute advantageous improvements and refinements of the method for the regeneration of a particulate filter put forward in the independent claim.

In a preferred embodiment of the method, it is provided for the throttle valve to be closed at the end of the regeneration of the particulate filter. Closing the throttle valve at the end of the regeneration creates a negative pressure in the intake tract of the internal combustion engine so that the internal combustion engine can re-start at a low power output. This allows the internal combustion engine to be coupled very gently, thus enhancing the driving comfort in the motor vehicle.

In a preferred embodiment of the invention, it is provided for the throttle valve to be placed in a defined position at the beginning of the regeneration. In order to start a defined regeneration process of the particulate filter, it is advantageous if the throttle valve is placed in a defined position at the beginning of the regeneration, that is to say, if the opening angle of the throttle valve is specifically defined at the beginning of the regeneration.

In this context, it is especially preferred if the opening angle of the throttle valve at the beginning of the regeneration of the particulate filter is between 30° and 70°. In order to attain a fast regeneration of the particulate filter without running the risk of an uncontrolled soot burn-off and thermal destruction of the particulate filter, it is advantageous to start the regeneration process with a partially opened throttle valve. In this context, opening angles between 30° and 70° have been found to be particularly practical since they constitute a good compromise between achieving a sufficiently fast regeneration and limiting the oxygen feed to the particulate filter.

According to an advantageous embodiment of the method, it is provided for the throttle valve to be closed in discrete increments. One possibility for carrying out the method according to the invention consists of moving the throttle valve in discrete increments from an at least partially closed initial state to an essentially closed final state. In this process, the increments can be selected as a function of the progress of the regeneration of the particulate filter or as a function of the temperature prevailing in the particulate filter.

In another advantageous embodiment of the method, it is provided for the opening angle of the throttle valve to be to continuously and steadily reduced from the beginning of the regeneration to the end of the regeneration of the particulate filter. At first, a steady closing of the throttle valve causes a relatively large amount of oxygen to be fed to the particulate filter at the beginning of the regeneration, bringing about a fast soot burn-off on the particulate filter. In this process, an uncontrolled temperature rise above a critical temperature can be avoided by closing the throttle valve. Moreover, the closing of the throttle valve before the internal combustion engine is re-started generates a negative pressure in the intake tract of the internal combustion engine, as a result of which it is possible to effectuate a gentle re-start of the internal combustion engine and a corresponding coupling of the power of the drive output of the internal combustion engine into the drive train of the hybrid vehicle. This prevents an abrupt re-start of the internal combustion engine, thus enhancing the driving comfort and the durability of the drive train.

In this context, it is particularly preferred if the closing of the throttle valve during the regeneration of the particulate filter takes place as a function of the temperature and/or of the soot load of the particulate filter. Changing the opening angle of the throttle valve as a function of the temperature and/or as a function of the soot load of the particulate filter allows a very fast regeneration of the particulate filter to be carried out without running the risk of thermal damage to the particulate filter.

In a preferred embodiment of the invention, it is provided for the regeneration process to be preceded by a heating process in which the particulate filter is heated up to the temperature range needed for the oxidation of the soot. Since the overrun mode of operation is normally associated with a temperature drop in the exhaust gas channel, it can be necessary to heat up the exhaust gas channel and thus the particulate filter to a regeneration temperature prior to initiating the regeneration. Since a sufficiently high temperature level as well as an oxygen excess in the exhaust gas channel are both needed for the regeneration of the particulate filter, such a heating phase is a simple as well as tried and true way to reach the temperature level. As elaborated upon, the oxygen excess is achieved by means of the lugging mode of operation of the internal combustion engine, whereby the internal combustion engine transports air into the exhaust gas channel.

In this context, it is particularly preferred if the regeneration of the particulate filter takes place in several steps, a process in which the heating phase and the regeneration phase alternate. If a complete regeneration of the particulate filter is not possible in one overrun phase, especially since the exhaust gas temperature falls below the lower threshold value, then a multi-stage regeneration of the particulate filter is carried out which involves alternating between the heating phase and the regeneration phase of the particulate filter. In this process, the internal combustion engine is connected to the drive train of the motor vehicle during the heating phase as well as during the regeneration phase. During the heating phases, the internal combustion engine is turning due to its own propulsion, while during the regeneration phases, the internal combustion engine is being lugged and thus turned by the electric motor. In this manner, a standstill of the motor/engine as well as a decoupling of the internal combustion engine from the electric motor are suppressed during the entire regeneration phase. A complete regeneration of the particulate filter can be attained by means of several regeneration steps.

According to an advantageous refinement of the method, it is provided for the internal combustion engine to be operated at a stoichiometric air-fuel ratio during the heating phase. A particularly good conversion of pollutants on a three-way catalytic converter installed upstream from the particulate filter can be achieved with a stoichiometric air-fuel ratio. Moreover, a stoichiometric air-fuel ratio of the internal combustion engine is particularly well-suited for heating up the exhaust gas since a lean air-fuel ratio is normally associated with a drop in the performance of the internal combustion engine, whereas a rich air-fuel ratio normally leads to cooling of the exhaust gas by the unburned fuel.

In a preferred embodiment of the method, it is provided for the load point of the internal combustion engine to be shifted during the heating phase in such a way that the internal combustion engine has to deliver an additional load due to the battery being charged. In this manner, the load is increased during the heating phase without the drive torque bringing about propulsion. As a result, under otherwise identical conditions (such as, for example, driving speed, engine rotational speed), the exhaust gas and thus the particulate filter are heated up more quickly than in the case of a motor vehicle that has only an internal combustion engine that propels the vehicle.

In another preferred configuration of the invention, it is provided that, when the load demand made of the hybrid drive exceeds a certain threshold value, especially the rated output of the electric motor, the throttle valve is used for throttling, and the internal combustion engine changes from the lugging mode of operation into the driving mode of operation, even if the regeneration of the particulate filter is still running but is not yet complete. If, during the regeneration, a load is required which is above the rated output of the electric motor, then the regeneration process of the particulate filter can be interrupted in order to deliver the maximum system output from the internal combustion engine and from the electric motor. In this process, the regeneration of the particulate filter is suppressed until the system output is once again below the threshold value and until the electric motor can generate the requisite drive torque and lugging torque of the internal combustion engine. Owing to the multi-stage regeneration of the particulate filter, it is possible to deliver the entire system output available on short notice, without having to fear damage to the particulate filter caused by overloading and thus a subsequent uncontrolled soot burn-off.

In a preferred embodiment, it is provided for the load point of the electric motor to be shifted during the regeneration of the particulate filter in such a way that the electric motor delivers the torque required by the driver and additionally lugs the internal combustion engine. As a result, additional power can be provided by the electric motor during the regeneration of the particulate filter, so that the regeneration process can be carried out without impairing the driving experience.

In this context, it is particularly advantageous if the regeneration of the particulate filter takes place in a torque-neutral manner when it comes to the propulsive drive torque of the motor vehicle, that is to say, if, during the regeneration of the particulate filter, the electric motor delivers precisely as much additional torque as is needed to lug the internal combustion engine. In this manner, the regeneration phases can be carried out very comfortably and almost unnoticed by the driver of the motor vehicle. The lugging torque that is provided to the drive train by the friction output of the inactive internal combustion engine is completely compensated for.

In another preferred embodiment of the invention, it is provided for the method to be carried out in an externally ignited internal combustion engine. As a matter of principle, the proposed method can be carried out in hybrid vehicles with a self-ignited engine as well as in externally ignited internal combustion engines. However, since self-ignited internal combustion engines that function according to the diesel method are usually operated with an appropriate oxygen excess, the provision of oxygen for the regeneration of the particulate filter only poses a minor challenge when it comes to a diesel hybrid. However, in the case of a gasoline hybrid, which is generally operated at a stoichiometric air-fuel ratio, additional measures are necessary in order to introduce oxygen into the exhaust gas channel for purposes of regenerating the particulate filter. Since an externally ignited internal combustion engine cannot be operated at a lean air-fuel ratio without limitations in terms of the power, of the exhaust gas behavior and/or of the driving comfort, the proposed method entails the advantage that a regeneration can be carried out, especially also at medium and lower partial loads of the types that occur, for example, during operation in city traffic.

According to the invention, a control unit for a motor vehicle with a hybrid drive is also being put forward with which such a method can be carried out. Such a control unit can very easily control the distribution of power between the electric motor and the internal combustion engine, thus creating the prerequisites needed for carrying out such a method.

According to the invention, a motor vehicle with a hybrid drive comprising an electric motor and an internal combustion engine is also being put forward, whereby a particulate filter is arranged in the exhaust gas channel of the internal combustion engine, said motor vehicle having a control unit to control the internal combustion engine and the electric motor, whereby the electric motor lugs the internal combustion engine during the regeneration of the particulate filter, and the internal combustion engine transports air into the exhaust gas channel for the oxidation of the soot particles retained in the particulate filter. With such a motor vehicle, the particulate filter can be regenerated very quickly and efficiently, without this regeneration entailing any loss in driving comfort or power to an extent that would be noticeable to the driver.

Additional preferred embodiments of the invention ensue from the other features cited in the subordinate claims.

Unless otherwise indicated in individual cases, the various embodiments of the invention cited in this application can be advantageously combined with each other.

BRIEF DESCRIPTION OF THE DRAWINGS

The invention will be explained in greater detail below in embodiments making reference to the accompanying drawings. The following is shown.

BRIEF DESCRIPTION OF THE DRAWINGS

Figure 1:
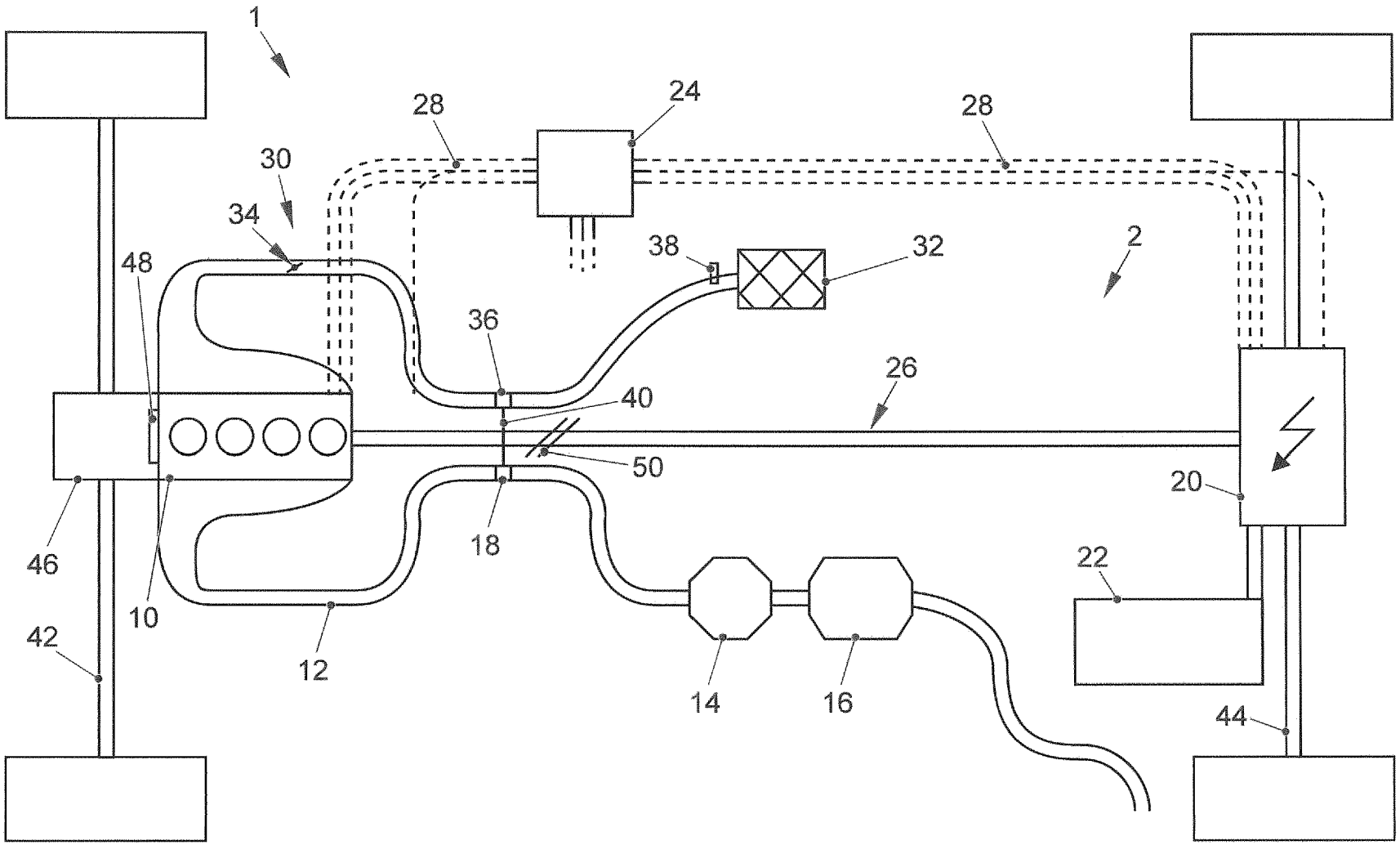
FIG. 1: a first embodiment of a motor vehicle according to the invention, with a hybrid drive consisting of an internal combustion engine and an electric motor.

FIG. 1 shows a schematic view of a motor vehicle 1 with a hybrid drive 2. The hybrid drive 2 comprises an internal combustion engine 10 and an electric motor 20, both of which can be operatively connected to a shared transmission 46 via a gear train 26. The internal combustion engine 10 is connected on the inlet side to an air supply means 30. In this context, as seen in the flow direction of the fresh air, the air supply means 30 has an air filter 32, an air mass meter 38 downstream from the air filter 32, and further downstream a compressor 36 of a turbocharger 40 and a throttle valve 34. The internal combustion engine 10 is connected on the outlet side to an exhaust gas channel 12 in which there is a turbine 18 in the flow direction of the exhaust gas, said turbine being connected to the compressor 36 of the turbocharger 40 via a shaft. Downstream from the turbine 18, there is a catalytic converter 14, and further downstream a particulate filter 16. The transmission 46 can be connected to the internal combustion engine 10 via a first coupling 48 and to the electric motor 20 via a second coupling 50. Here, the internal combustion engine 10 and the electric motor 20 can each propel the motor vehicle 1, either individually or jointly. For this purpose, the internal combustion engine 10 is connected via the transmission 46 to a first drive axle of the motor vehicle 1, and the electric motor 20 is connected to a second drive axle 44 of the motor vehicle 1. The electric motor 20 is connected to a battery 22 that supplies the electric motor 20 with electric power. The electric motor 20 and the internal combustion engine are connected via signal lines 28 to a control unit 24 of the hybrid drive 2 that transmits the power demands of the driver to the two drive aggregates 10, 20. As an alternative, the hybrid drive 2 can also be configured with a naturally aspirated engine, whereby in this case, the turbocharger 40 with the compressor 36 and the turbine 18 have been eliminated.

Figure 2:
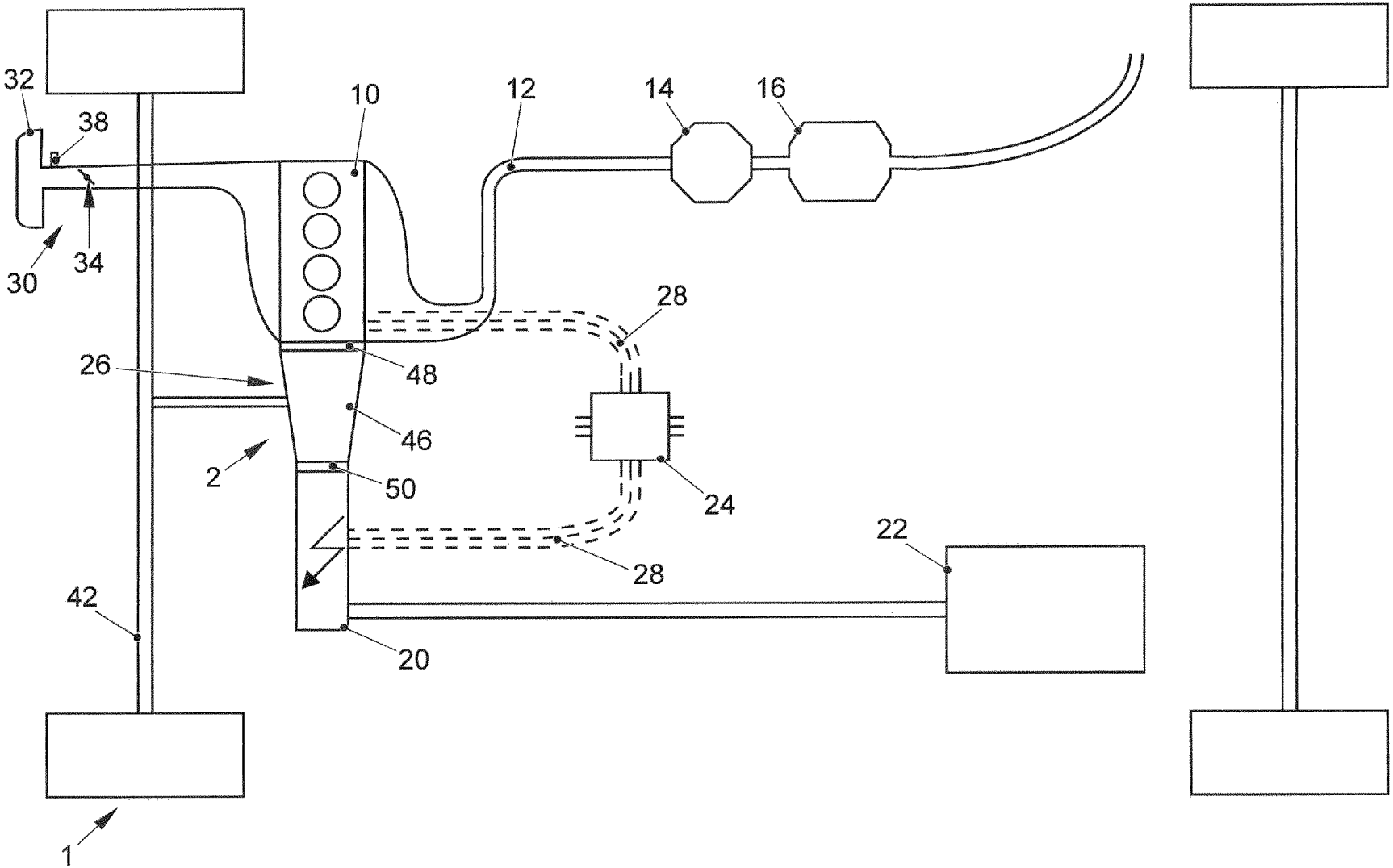
FIG. 2: another embodiment of a motor vehicle according to the invention, with a hybrid drive.

FIG. 2 shows another embodiment of a motor vehicle 1 according to the invention, with a hybrid drive 2. In this context, the internal combustion engine 10 and the electric motor 20 are preferably arranged crosswise to the driving direction of the motor vehicle 1 in an engine compartment located at the front of the motor vehicle. As an alternative, the internal combustion engine 10 and the electric motor 20 can also be arranged along the driving direction. Between the internal combustion engine 10 and the transmission 46, there is a first coupling 48 via which the internal combustion engine 10 can be mechanically connected to the transmission 46. The first coupling 48 can be configured either as a simple shifting clutch or else as a preferably automatic dual clutch. Between the transmission 46 and the electric motor 20, there is another coupling 50 that allows the electric motor 20 to be coupled and uncoupled.

A tank for the internal combustion engine 10 and a battery 22 for the electric motor 20 are arranged in the rear of the vehicle in order to achieve a uniform weight distribution between the first drive axle 42, preferably the front axle of the motor vehicle 1, and the second axle, preferably the rear axle. As an alternative, the tank and/or the battery 22 can also be arranged in other places in the motor vehicle 1.

The internal combustion engine 10 has an air supply means 30 in which, as seen in the flow direction of the fresh air, there is an air filter 32 as well as an air mass meter 38 downstream from the air filter 32. As an alternative, the air mass meter 38, especially a hot-film air mass meter, can also be integrated into the air filter 32. Downstream from the air mass meter 38, there is a throttle valve 34 that can regulate the air feed into the combustion chambers of the internal combustion engine 10.

The electric motor 20 and the internal combustion engine 10 can be connected to each other via a shared drive train 26, whereby they can be connected and disconnected by means of the couplings 48 and 50. When only one of the couplings 48 or 50 is closed, a selection can be made to operate the motor vehicle 1 either exclusively electrically by means of the electric motor 20 or else exclusively by means of the internal combustion engine 10. If both couplings 48 and 50 are closed, both drive aggregates 10, 20 can carry out a boost operation, a recuperation, in other words, charging of the battery 22 of the electric motor 20, or else an electric braking operation. The transmission 46 is connected to a differential that propels the wheels of the first drive axle 42, especially the front axle, via drive shafts.

The internal combustion engine 10 has an exhaust gas channel 12 in which a three-way catalytic converter 14 and a particulate filter 16 are installed. A control unit 24 is provided to control the internal combustion engine 10 and the electric motor 20, said control unit 24 being connected to the internal combustion engine 10 via first signal lines 28, and to the electric motor 20 via second signal lines 28.

During normal operation, the motor vehicle 1 is operated in a hybrid mode of operation in which the torque that the driver has requested from a given drive aggregate 10, 20 is transmitted by the control unit 24 to the internal combustion engine 10, to the electric motor 20, or to both drive aggregates 10, 20. The operating strategy of the hybrid drive 2 stored in the control unit 24 prescribes the way in which the driver request will be met. In this process, the drive torque is provided either completely by the electric motor 20, or by distributing the drive torque between the electric motor 20 and the internal combustion engine 10, or else completely by the internal combustion engine 10. In the hybrid mode of operation, it is also possible for the internal combustion engine 10 to generate more torque than is necessary to propel the motor vehicle, whereby the extra torque brought about by coupling the electric motor 20 via the coupling 50 is used in order to charge the battery 22 of the electric motor 20.

While the internal combustion engine 10 is active, the exhaust gas of the internal combustion engine is transported through the particulate filter 16 in the exhaust gas channel 12. During the hybrid mode of operation, the particulate filter 16 is loaded with soot particles until a maximally permissible load state of the particulate filter 16 is reached.

Figure 3:
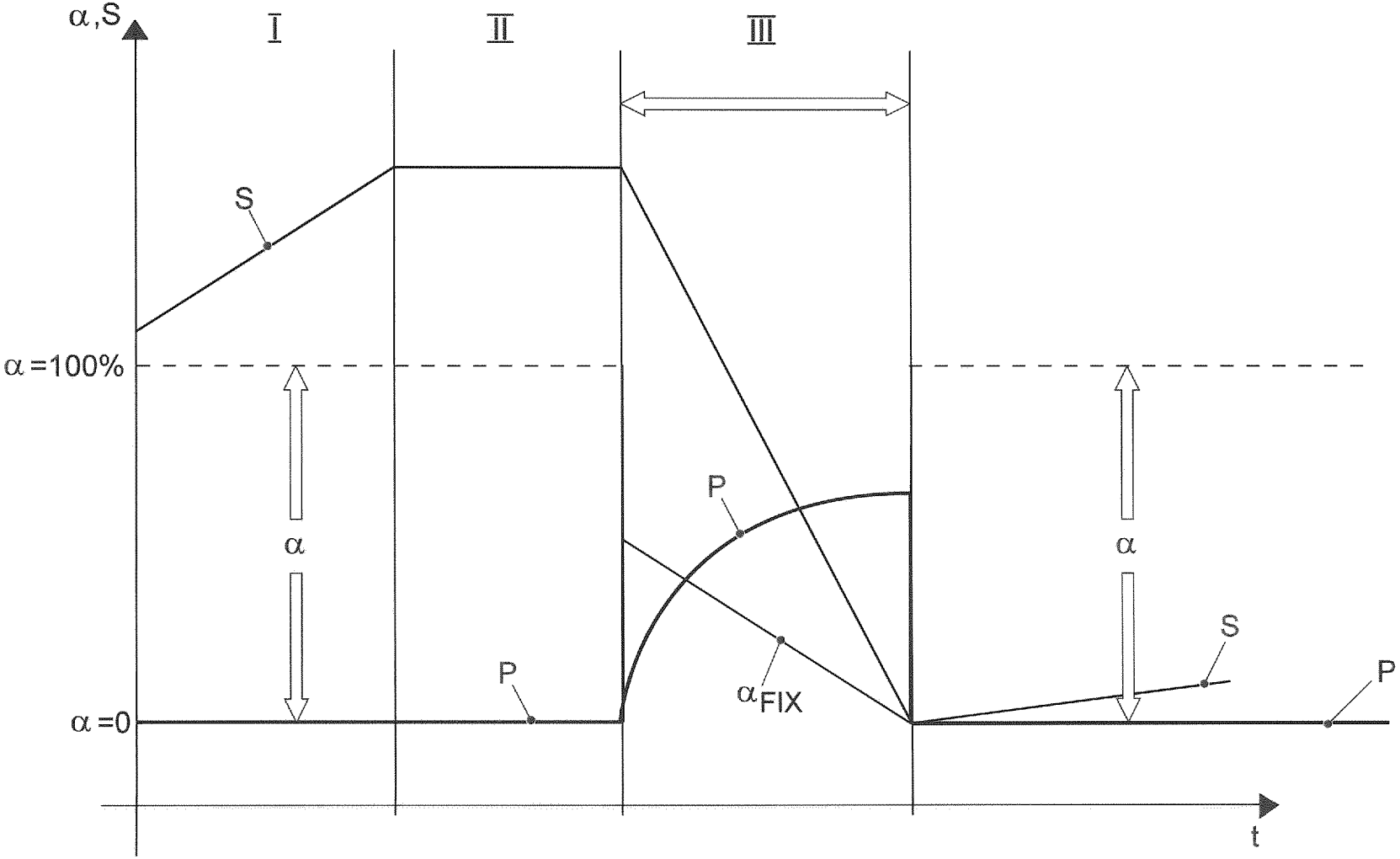
FIG. 3: a first flow diagram of a method according to the invention for the regeneration of a particulate filter in a motor vehicle with a hybrid drive.
Figure 4:
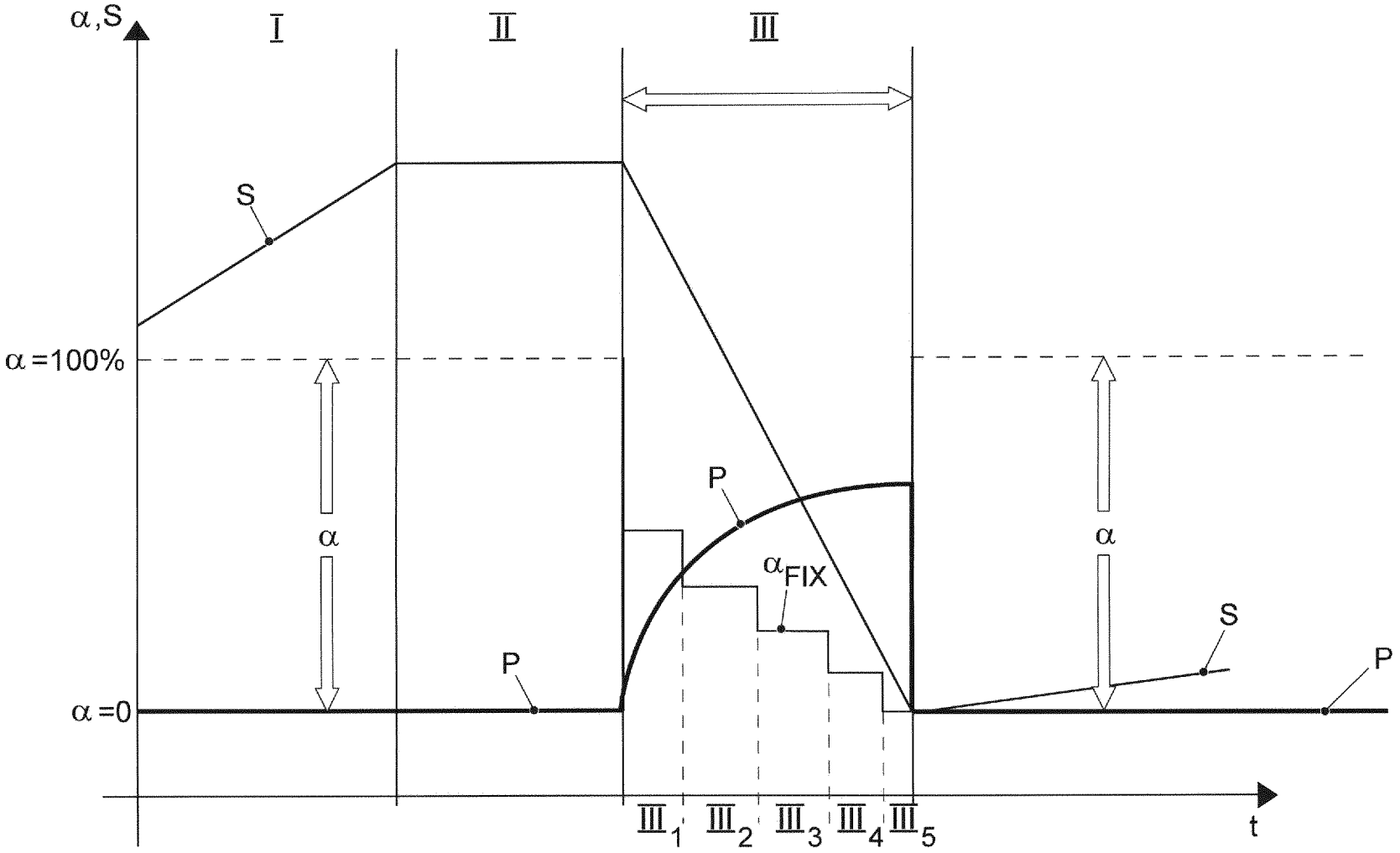
FIG. 4 another flow diagram of a method according to the invention for the regeneration of a particulate filter in a motor vehicle with a hybrid drive.

FIG. 3 shows a flow chart for the regeneration of the particulate filter 16. In a first phase I, the motor vehicle is operated in a hybrid mode of operation I until the particulate filter 16 reaches a maximally permissible load state. In this process, the opening angle α of the throttle valve 34 can be varied between 0% and 100%, and it depends on the power demand being made of the internal combustion engine 10. The maximally permissible load state can be determined by means of a differential pressure measurement via the particulate filter 16 or else by means of a modeling of the soot that enters into and exits from the particulate filter 16 employing a calculation model stored in the control unit 24. If it is ascertained that there is a need for the particulate filter 16 to be regenerated, then, in a second phase II, the particulate filter 16 is heated up to the temperature needed for the regeneration. The heating phase II of the particulate filter 16 is followed by the regeneration phase III of the particulate filter 16. The regeneration phase III of the particulate filter 16 can be carried out in several steps III1 to III5 as shown in FIG. 4, or else continuously as shown in FIG. 3. FIG. 4 shows a regeneration involving five regeneration steps, but regenerations with more or fewer regeneration steps are likewise possible. Moreover, the heating phase II can be dispensed with if the particulate filter 16 is already at the temperature needed to oxidize the soot that had been retained in the particulate filter 16 when the regeneration phase III was initiated. During the heating phase II, the internal combustion engine 10 is operated under load until an upper threshold temperature TSO has been reached. This upper threshold temperature is, for instance, 750° C., as a result of which ideal conditions are created for the oxidation of the soot retained in the particulate filter 16. The heating phase II can involve, for example, a shift of the ignition point in the late direction and/or an additional loading of the internal combustion engine 10 through a generator operation of the electric motor 20. In this context, the internal combustion engine 10 is preferably operated at a stoichiometric air-fuel ratio. Once the upper threshold temperature $T_{SO}$ has been reached, the injection of fuel into the combustion chambers of the internal combustion engine 10 is stopped and the internal combustion engine 10 is lugged by the electric motor 20. During this regeneration phase III, the internal combustion engine 10 is turned by the electric motor 20, a process in which the internal combustion engine 10 transports air into the exhaust gas channel 12. During the regeneration phase III, which constitutes an overrun phase of the internal combustion engine 10, the soot in the particulate filter 16 is oxidized, whereby the exhaust gas temperature drops due to the absence of burning in the combustion chambers of the internal combustion engine 10. Here, as an alternative, the injection of fuel into individual cylinders or into all of the cylinders of the internal combustion engine 10 can be discontinued. During the regeneration phase III, the internal combustion engine 10 does not deliver any drive torque, so that the entire drive torque has to be generated by the electric motor 20. Here, the opening angle α of the throttle valve 34 is set at a fixed value, for example, 50%, at the beginning of the regeneration of the particulate filter 16, and the throttle valve 34 is continuously closed during the regeneration of the particulate filter 16 until an opening angle α of the throttle valve 34 of 0%, that is to say, a maximum throttling of the quantity of fresh air, is reached at the end of the regeneration. The regeneration phase III is maintained until the temperature at the particulate filter 16 has reached a lower threshold value $T_{SU}$ of approximately 600° C. No further oxidation of the soot is possible below this temperature, so that a heating phase II has to be initiated once again. For the regeneration of the particulate filter 16, it is possible to alternate between heating phase II and regeneration phase III. This alternation between heating phase II and regeneration phase III is continuously repeated until the particulate filter 16 can be considered to have been regenerated, which can be done by means of a differential pressure measurement via the particulate filter 16 or else by means of modeling of the load state via a calculation model. Closing the throttle valve 34 at the end of the regeneration III creates a negative pressure in the intake duct of the internal combustion engine 10, thus allowing a very gentle re-start of the combustion in the combustion chambers of the internal combustion engine 10.

After the regeneration of the particulate filter 16 has been successfully completed, the motor vehicle is once again operated in a hybrid mode of operation I and the particulate filter 16 is once again loaded with soot particles.

FIG. 4 shows another diagram for the regeneration of the particulate filter 16. In a sequence that is essentially the same as that described in FIG. 3, the throttle valve 34 is closed here in discrete increments by, for example, 10% per increment. In this process, at the beginning of the regeneration $III_1$ of the particulate filter 16, the throttle valve 34 is opened by a defined, fixed opening angle α of, for instance, 60%, whereby with every further step $III_2$ to $III_5$, the throttle valve 34 is closed further by a defined amount until, by the completion of the regeneration of the particulate filter 16, the throttle valve 34 is at least essentially closed and has a maximal residual opening of 10%.

If a load demand that exceeds the output of the electric motor 20 is made of the hybrid drive 2 during the regeneration of the particulate filter 16, then the throttle valve 34 is closed in order to facilitate the start-up of the internal combustion engine 10. The regeneration phase III of the particulate filter 16 is interrupted in this process until appropriate conditions for a regeneration of the particulate filter 16 are once again present.

The method according to the invention creates a very efficient mechanism for burning off soot particles on the particulate filter 16. Owing to the lugging operation of the internal combustion engine 10 by the electric motor 20, the inflow of oxygen into the exhaust gas channel 12 can be regulated largely independently of the load point of the hybrid drive 2. The torque needed to lug the internal combustion engine 10 is generated by the electric motor 20, so that the regeneration of the particulate filter 16 is imperceptible to the driver of the motor vehicle 1 and also very comfortable.

In order to optimize the regeneration, as described above, the load point of the internal combustion engine 10 (especially during the heating phase II) as well as the load point of the electric motor 20 can be shifted during the overrun phase. In this process, the internal combustion engine 10 is uncoupled from the drive train of the motor vehicle 1 with the hybrid drive 2 during the regeneration. This yields a very simple regeneration possibility for the particulate filter 16.

LIST OF REFERENCE NUMERALS

1 motor vehicle
2 hybrid drive
10 internal combustion engine
12 exhaust gas channel
14 catalytic converter
16 particulate filter
18 turbine
20 electric motor

22 battery
24 control unit
26 drive train
28 signal line
30 air supply means
32 air filter
34 throttle valve
36 compressor
38 air mass meter
40 turbocharger
42 first drive axle
44 second drive axle
46 transmission
48 first coupling
50 second coupling
S soot load of the particulate filter
P progress of the particulate filter regeneration
t time
$\alpha$ opening angle of the throttle valve
$\alpha_{FIX}$ opening angle during the regeneration as prescribed by the method
I hybrid drive
II heating phase of the particulate filter
III regeneration phase of the particulate filter
$III_1$ first step of the regeneration
$III_2$ second step of the regeneration
$III_3$ third step of the regeneration
$III_4$ fourth step of the regeneration
$III_5$ fifth step of the regeneration

The invention claimed is:

1. A method for regenerating a particulate filter in an exhaust gas channel of a motor vehicle with a hybrid drive consisting of an electric motor and an internal combustion engine, whereby the particulate filter is arranged in the exhaust gas channel of the internal combustion engine, and whereby the internal combustion engine is connected to an air supply means comprising a throttle valve, said method comprising the following steps:

operating the motor vehicle in the hybrid mode of operation, whereby the exhaust gas of the internal combustion engine is transported through the particulate filter during the operation of the internal combustion engine, ascertaining the load state of the particulate filter, initiating the regeneration of the particulate filter once the load state of the particulate filter has reached a defined maximum load state, carrying out a regeneration process of the particulate filter, whereby the internal combustion engine and the electric motor are coupled during the regeneration and the electric motor lugs the internal combustion engine, whereby transporting air, by the internal combustion engine, into the exhaust gas channel in order to oxidize the soot particles retained in the particulate filter, and controlling the throttle valve of the air supply means of the internal combustion engine during the regeneration of the particulate filter, irrespective of any torque demand the driver makes of the hybrid drive, while the internal combustion engine is dragged by the electric motor and fuel supply to the internal combustion engine is switched off, wherein the method is carried out in an externally ignited internal combustion engine, and wherein the throttle valve is closed at the end of the regeneration of the particulate filter.

2. The method according to claim 1, wherein the throttle valve is placed in a defined position at the beginning of the regeneration of the particulate filter.

3. The method according to claim 2, wherein the opening angle of the throttle valve at the beginning of the regeneration yields a markedly unthrottled operating point.

4. The method according to claim 3, wherein the opening angle of the throttle valve at the beginning of the regeneration is between 30° and 70°.

5. The method according to claim 1, wherein the opening angle of the throttle valve is continuously and steadily reduced from the beginning of the regeneration to the end of the regeneration.

6. The method according to claim 5, wherein the reduction of the opening angle of the throttle valve during the regeneration of the particulate filter takes place as a function of the temperature and/or the soot load of the particulate filter.

7. The method according to claim 1, characterized in that wherein the regeneration process is preceded by a heating process in which the particulate filter is heated up to the temperature range needed for the oxidation of the soot.

8. The method according to claim 7, wherein the internal combustion engine is operated at a stoichiometric air-fuel ratio during the heating phase.

9. The method according to claim 7, wherein the load point of the internal combustion engine is shifted during the heating phase in such a way that the internal combustion engine has to deliver an additional load to counter the work of the electric motor due to the battery being charged.

10. The method according to claim 1, wherein the throttle valve is closed and the internal combustion engine is started, even if the regeneration of the particulate filter is not yet complete, when the load demand made of the hybrid drive exceeds a certain threshold value.

11. The method according to claim 1, wherein the load point of the electric motor is shifted during the regeneration of the particulate filter in such a way that exclusively the electric motor delivers the torque required by the driver for the motor vehicle and additionally lugs the internal combustion engine.

12. The method according to claim 11, wherein the regeneration of the particulate filter takes place in a torque-neutral manner when it comes to the propulsive drive torque of the motor vehicle.

13. A control unit for a motor vehicle with a hybrid drive consisting of an internal combustion engine and an electric motor, said control unit being configured to carry out a method according to claim 1.

* * * * *